US010470951B2

(12) United States Patent
Kitchin et al.

(10) Patent No.: US 10,470,951 B2
(45) Date of Patent: Nov. 12, 2019

(54) WHEELCHAIR LIFT

(71) Applicant: All-Terrain Conversions, LLC, Markle, IN (US)

(72) Inventors: Steven L. Kitchin, Markle, IN (US); Trent L. Bradburn, Muncie, IN (US); Kraig James Schlosser, Columbia City, IN (US)

(73) Assignee: All-Terrian Conversions, LLC, Markle, IN (US)

( * ) Notice: Subject to any disclaimer, the term of this patent is extended or adjusted under 35 U.S.C. 154(b) by 76 days.

(21) Appl. No.: 15/350,346

(22) Filed: Nov. 14, 2016

(65) Prior Publication Data

US 2017/0135878 A1 May 18, 2017

Related U.S. Application Data

(60) Provisional application No. 62/254,502, filed on Nov. 12, 2015.

(51) Int. Cl.
*A61G 3/06* (2006.01)

(52) U.S. Cl.
CPC ..... *A61G 3/062* (2013.01)

(58) Field of Classification Search
CPC . A61G 3/02; A61G 3/06; A61G 3/062; A61G 2203/726
See application file for complete search history.

(56) References Cited

U.S. PATENT DOCUMENTS 2,792,951 A * 5/1957 White ..... A61G 3/06 297/344.24
3,516,559 A * 6/1970 Walter ..... B60P 1/4428 187/901
3,638,813 A 2/1972 Strong
4,479,753 A 10/1984 Thorley
4,493,603 A * 1/1985 Williams ..... A61G 3/06 414/541
4,551,060 A * 11/1985 Quercy ..... B60N 2/245 187/200
4,664,584 A * 5/1987 Braun ..... A61G 3/06 187/217

(Continued)

FOREIGN PATENT DOCUMENTS

EP 2178484 B1 11/2011
FR 2756729 A1 * 6/1998 ..... A61G 3/02

(Continued)

OTHER PUBLICATIONS

Bruno, Interior Platform Vehicle Lift; Date of Publication 2009; http://www.superiorvan.com/img/scooter-lifts/bruno-joey.pdf.

*Primary Examiner* — Glenn F Myers
(74) *Attorney, Agent, or Firm* — Barnes & Thornburg LLP

(57) ABSTRACT

A wheelchair lift for a vehicle having a cab with a rear seat. The wheelchair lift includes a lift tray dimensioned to support a wheelchair. An articulating assembly is provided that is configured to move the lift tray transversely between an extended position outside a cab of a vehicle and a retracted position fully within the cab of the vehicle. The wheelchair lift includes a vertical lift assembly configured to raise and lower the lift tray. In some cases, the articulating assembly is mounted to a vertical wall of a vehicle cab between a rear seat and a vehicle door.

16 Claims, 6 Drawing Sheets

(56) References Cited

U.S. PATENT DOCUMENTS

| | | | | |
|---|---|---|---|---|
| 5,746,465 | A * | 5/1998 | Jones | B60N 2/14 296/65.03 |
| 6,357,992 | B1 | 3/2002 | Ringdahl et al. | |
| 6,821,078 | B2 * | 11/2004 | Dudai | A61G 5/045 296/65.04 |
| 8,398,356 | B2 * | 3/2013 | Sandoz | A61G 3/0808 414/541 |
| 8,998,558 | B2 | 4/2015 | Kitchin et al. | |
| 9,358,905 | B2 * | 6/2016 | Weersink | B60N 2/1665 |
| 9,603,759 | B2 | 3/2017 | Kitchin et al. | |
| 10,010,461 | B2 | 7/2018 | Kitchin et al. | |
| 2005/0098393 | A1 * | 5/2005 | Gennaro | A61G 3/063 187/414 |
| 2007/0059136 | A1 * | 3/2007 | Schlangen | B60P 1/4421 414/467 |

FOREIGN PATENT DOCUMENTS

| | | | | |
|---|---|---|---|---|
| FR | 2878433 | A1 | 6/2006 | |
| GB | 2202202 | A * | 9/1988 | B60P 1/4428 |

* cited by examiner

WHEELCHAIR LIFT

RELATED APPLICATIONS

This application claims the benefit of U.S. Provisional Application Ser. No. 62/254,502 filed Nov. 12, 2015, for an All-Terrain Truck and SUV, which is hereby incorporated by reference in its entirety.

TECHNICAL FIELD

The present disclosure relates generally to an apparatus for an all-terrain truck and SUV. More specifically, the present disclosure provides a wheelchair lift assembly that allows an individual in a wheelchair access to a vehicle, but does it in a unique and advantageous way.

BACKGROUND

There have been numerous vehicles modified over the years to allow wheel chair users the ability to enter or egress from them. Most common types will use a fold out ramp or a lifting apparatus to perform this task. Nearly all modified vehicles also need to have the floor lowered, or the ceiling raised, to allow adequate height for an individual in a wheel chair enough vertical room to fit inside the vehicle.

The present invention also allows an individual in a wheelchair access to a vehicle, but does it in a unique and advantageous way. On most ramp style vehicles, the ramp will deploy and protrude out from the door opening, causing the ramp to protrude from vehicle several feet, requiring an exceptionally large parking area in order to be used. Other variations have a lift assembly that fits under the rear seat, like in a pickup truck. The apparatus takes up much of the space under the seat and is very heavy. This invention occupies the small space between the rear seat and the door leaving most of the space under the seat available for storage.

SUMMARY

According to one aspect, this disclosure provides a wheelchair lift for a vehicle having a cab with a rear seat. The wheelchair lift includes a lift tray dimensioned to support a wheelchair. There is means for articulating the lift tray transversely between an extended position outside a cab of a vehicle and a retracted position fully within the cab of the vehicle. The wheelchair lift also includes means for lifting and lowering the lift tray. In some cases, the articulating means is movable between the extended and retracted positions without interrupting a space beneath a rear seat of the vehicle.

Depending upon the circumstances, the articulating means could be configured to pivot about a substantially vertical axis when moving between the extended and retracted positions. In some embodiments, the articulating means is pivotally connected to the cab of the vehicle. The articulating means could be attached to a vertical wall of the cab of the vehicle in some embodiments.

Embodiments are contemplated in which the articulating means could be positioned adjacent to the rear seat of the vehicle. In some cases, the articulating means is positioned between the rear seat of the vehicle and a door of the vehicle. In some embodiments, the articulating means is fully outside a space beneath the rear seat of the vehicle while moving between the extended and retracted positions.

According to another aspect, this disclosure provides a wheelchair lift for a vehicle having a cab with a rear seat. The wheelchair lift includes a lift tray dimensioned to support a wheelchair. An articulating assembly is provided that is configured to move the lift tray transversely between an extended position outside a cab of a vehicle and a retracted position fully within the cab of the vehicle. The wheelchair lift includes a vertical lift assembly configured to raise and lower the lift tray. In some cases, the articulating assembly is mounted to a vertical wall of a vehicle cab between a rear seat and a vehicle door. The articulating assembly includes a swivel beam pivotally mounted to the vertical wall of the vehicle cab in some embodiments. For example, the swivel beam could be configured to pivot about a vertical axis. In some cases, the swivel beam is pivotally connected, either directly or indirectly, to the vertical lift assembly. Depending on the circumstances, one or more guide linkages could pivotally connect the lift tray and the cab. In some embodiments, the articulating assembly includes a swivel link pivotally connecting the swivel beam and the vertical lift assembly.

In some embodiments, the vertical lift assembly includes an inner vertical beam slidably engaged with an outer vertical beam. For example, the inner vertical beam is attached to the lift tray. In some cases, a linear actuator could be configured to move the inner beam with respect to the outer beam. Embodiments are contemplated in which the articulating assembly is fully outside a space beneath the rear seat of the vehicle while moving between the extended and retracted positions.

According to a further aspect, this disclosure provides a wheelchair lift for a vehicle having a cab with a rear seat. The wheelchair lift includes a lift tray dimensioned to support a wheelchair. An articulating assembly is provided for moving the lift tray transversely between an extended position outside a cab of a vehicle and a retracted position fully within the cab of the vehicle. The wheelchair lift includes a vertical lift assembly configured to raise and lower the lift tray. In some cases, the articulating assembly is mounted to a vertical wall of a vehicle cab between a rear seat and a vehicle door. In some embodiments, the articulating assembly is fully outside a space beneath the rear seat of the vehicle while moving between the extended and retracted positions. Depending on the circumstances, the articulating assembly includes a swivel beam pivotally mounted to the vertical wall of the vehicle cab. The swivel beam is pivotally connected, either directly or indirectly, to the vertical lift assembly. For example, the articulating assembly could include a swivel link pivotally connecting the swivel beam and the vertical lift assembly.

BRIEF DESCRIPTION OF THE DRAWINGS

The present disclosure will be described hereafter with reference to the attached drawings which are given as non-limiting examples only, in which.

Figure 1:
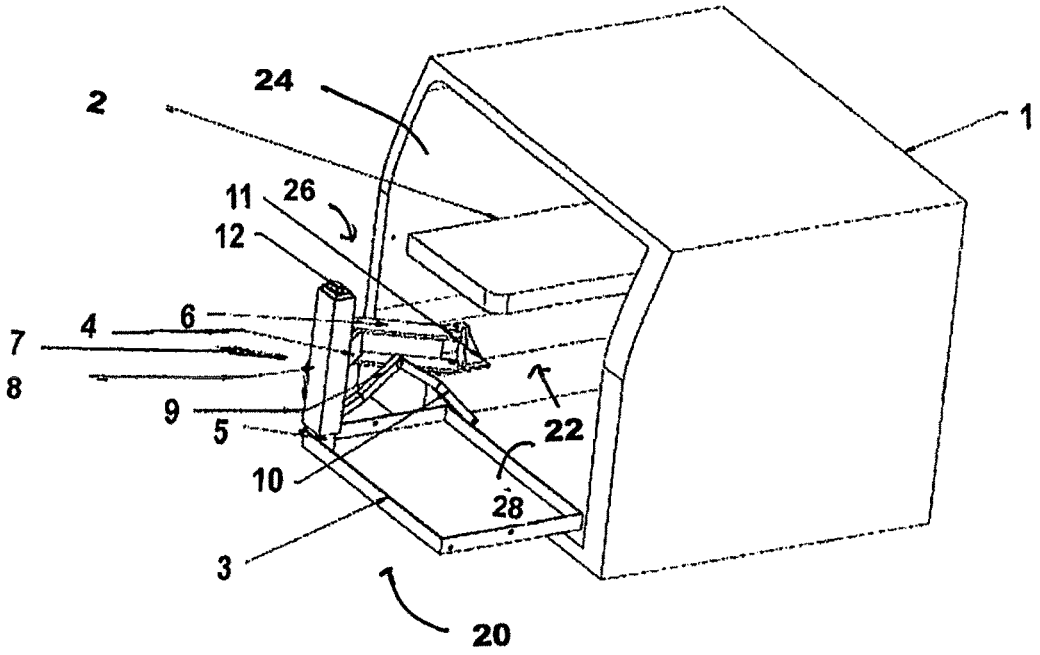
FIG. 1 is a perspective view of an example wheelchair lift with the lift tray partially extended according to an embodiment of this disclosure.

Corresponding reference characters indicate corresponding parts throughout the several views. The components in the figures are not necessarily to scale, emphasis instead being placed upon illustrating the principals of the invention. The exemplification set out herein illustrates embodiments of the invention, and such exemplification is not to be construed as limiting the scope of the invention in any manner.

DETAILED DESCRIPTION OF THE DRAWINGS

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

According to one aspect, this disclosure provides a wheelchair lift 20. The wheelchair lift could be installed in a variety of vehicles, such as a crew cab pickup truck, a sport utility vehicle ("SUV"), etc. FIG. 1 shows an example cab structure 1 of a vehicle. The cab 1 is the enclosed space of the vehicle in which the driver is seated. In some cases, the cab 1 could have a single row of seating, which would include the front row in which driver is seated, such as with a pickup truck with a regular cab. In other cases, the cab 1 could include two rows of seating, such as with a crew cab pickup truck or SUV, in which there is a front row in which the driver is seated and also a back row seating area (and in some cases there could be multiple rows of seating behind the front row). In the example cab 1 shown in FIG. 1, there is a rear seat 2.

Figure 4:
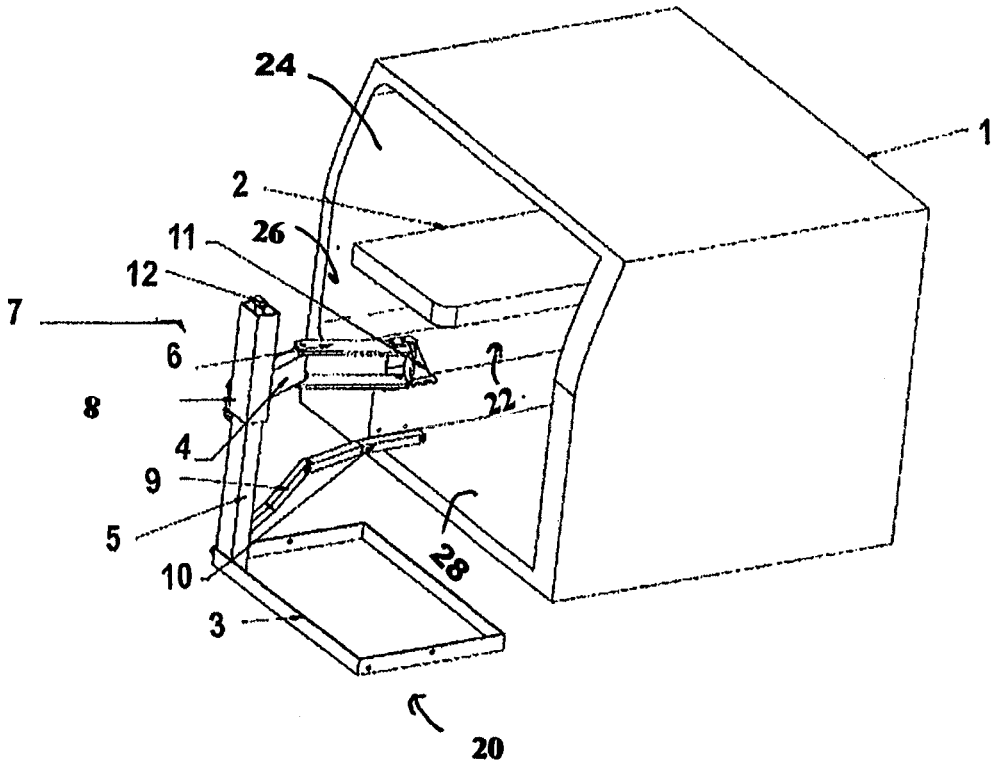
FIG. 4 is a perspective view of the example wheelchair lift shown in FIG. 1 with the lift tray in the extended position.
Figure 6:
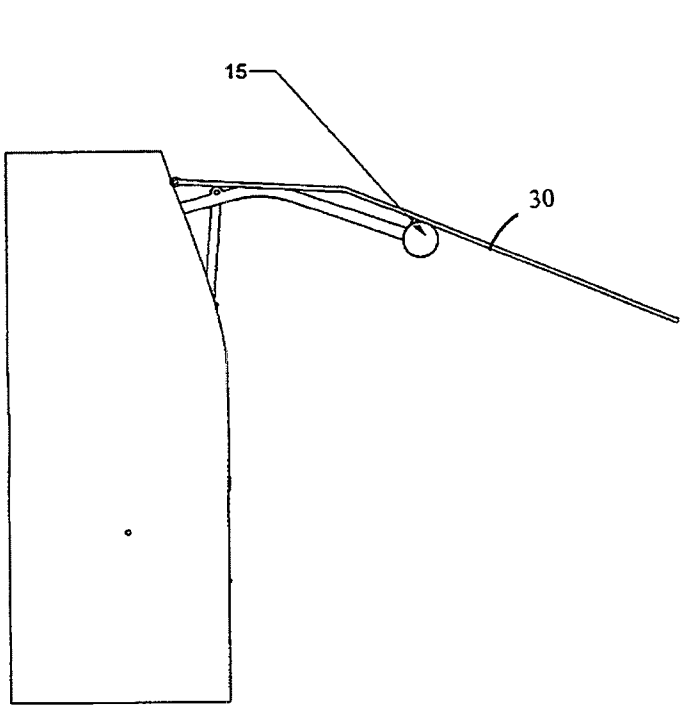
FIG. 6 is front view of the example gull wing door show in FIG. 5.
Figure 5:
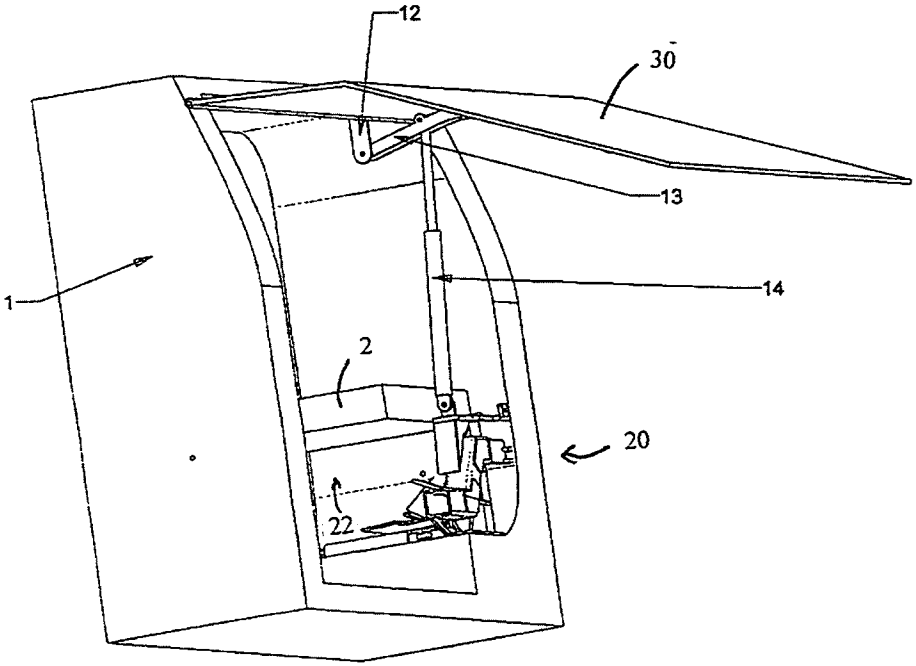
FIG. 5 is a perspective view of an example gull wing door in an extended position for use with the wheelchair lift according to an embodiment of this disclosure.
Figure 7:
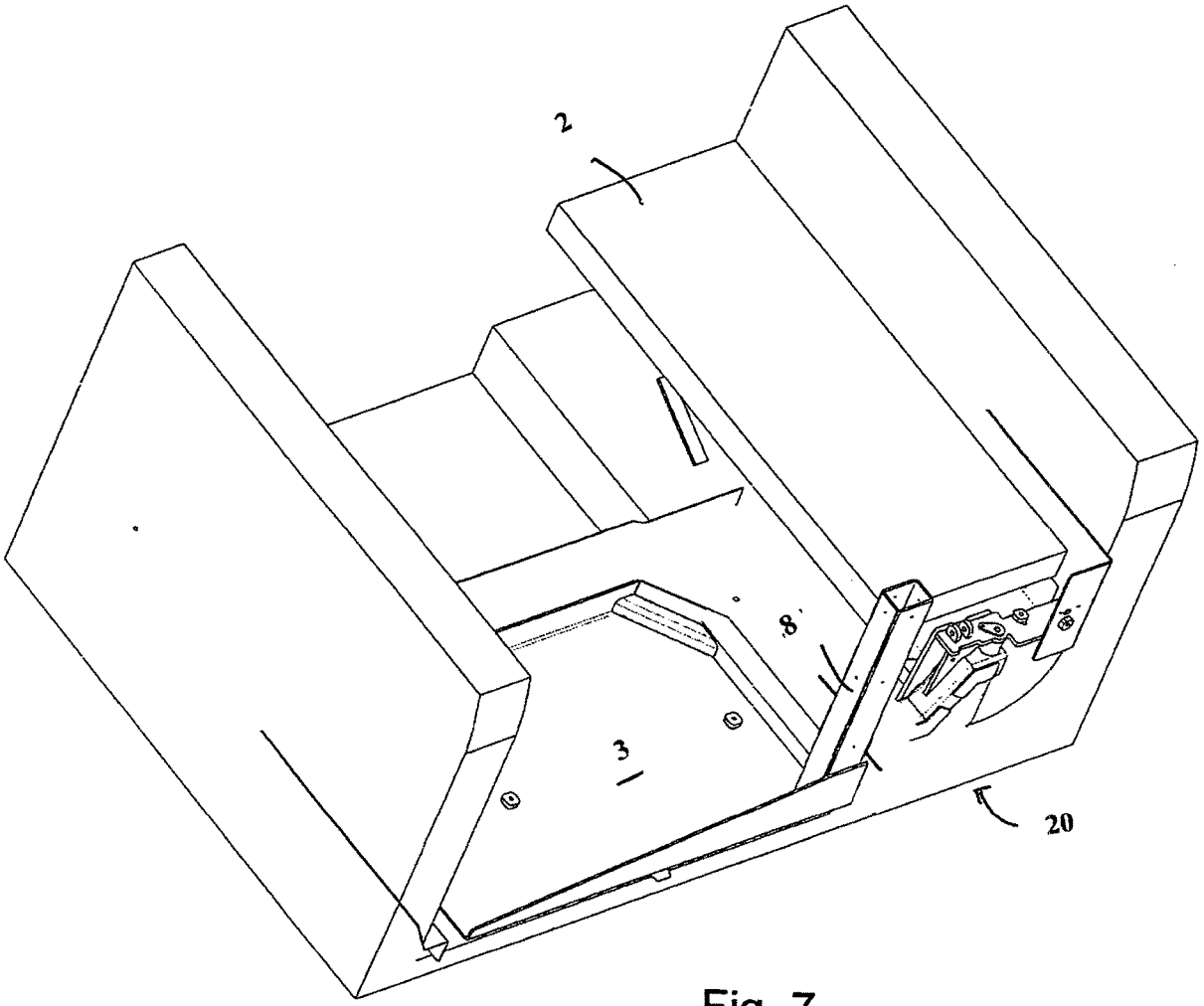
FIG. 7 is a top perspective view of an example wheelchair lift according to an embodiment of the present disclosure.

In the example shown, the cab 1 defines an opening through which the wheelchair lift 20 moves between a retracted position and an extended position. For example, the opening could be opened or closed with a vehicle door, such as shown in FIGS. 5 and 6. In the retracted position (FIG. 2), the wheelchair lift 20 is fully within the cab 1. In the extended position (FIG. 4), the wheelchair lift is extended outside the cab 1 and the lift tray 3 for holding a wheelchair is lowered to a surface onto the wheelchair can exit the lift tray 3. Accordingly, the wheelchair lift 20 can be moved to the extended position to receive a wheelchair, and then when moving to the retracted position, lift the wheelchair into the cab so the passenger is fully within the cabin. In the embodiment shown, the articulating assembly 26 for moving the wheelchair lift 20 transversely between its extended and retracted positions can be substantially positioned between rear seat 2 and the door (FIGS. 5 and 7), which allows most of the space 22 under the rear seat 2 available for storage.

FIG. 1 shows the wheelchair lift 20 partially articulated, approximately half way between its retracted and its extended position. In the example shown, the lift tray 3 extends out the cab 1. As shown, the lift tray 3 is connected to an articulating assembly 26 to pivot transversely between the retracted position and the extended position. In this embodiment, the lift tray 3 is attached to a wall 24 of the cab via an articulating assembly 26. As shown, the articulating assembly 26 is mounted to the wall 24 below the rear seat 2, between the rear seat 2 and a cabin floor 28. As shown, the mounting point for the articulating assembly 26 is a pedestal base 11 affixed to the wall 24 near the end of the rear seat 2 and the door. In the example shown, a proximate end of a swivel beam 6 is pivotally attached to the pedestal base 11 and the distal end of the swivel beam 6 is pivotally connected to a swivel link 4. The swivel link 4 connects the swivel beam 6 to a hydraulic cylinder assembly 7 for raising and lowering the lift tray 3. A horizontal hydraulic cylinder could be provided to move the articulating assembly 26 transversely in and out of the cab 1.

As shown, the swivel link 4 is connected to an outer vertical beam 8 of the hydraulic cylinder assembly 7. The hydraulic cylinder assembly 7 includes an inner vertical beam 5 that is connected to the lift tray 3. As shown, the hydraulic cylinder assembly 7 includes a hydraulic cylinder 12 that can be actuated to move the inner vertical beam 5 with respect to the outer vertical beam 8 to raise and lower the lift tray 3. In the example shown, the articulating assembly 26 includes guide linkages 9 and 10 for guiding movement of the lifting tray 3 between its extended and retracted positions. As shown, the guide linkages 9 and 10 are configured to pivot with respect to each other. In the example shown, a proximate end of guide linkage 10 is pivotally mounted to the floor 28 of the cab 1 while the distal end of the guide linkage 10 is pivotally connected to the guide linkage 9. As shown, the distal end of the guide linkage 9 is connected to the outer vertical beam 8 of the hydraulic cylinder assembly 7. In an alternative embodiment, the swivel beam 6 and swivel link 4 could be rigidly attached to each other, or become a single component, eliminating the pivot and eliminating the need for guide linkages 9 and 10.

Figure 2:
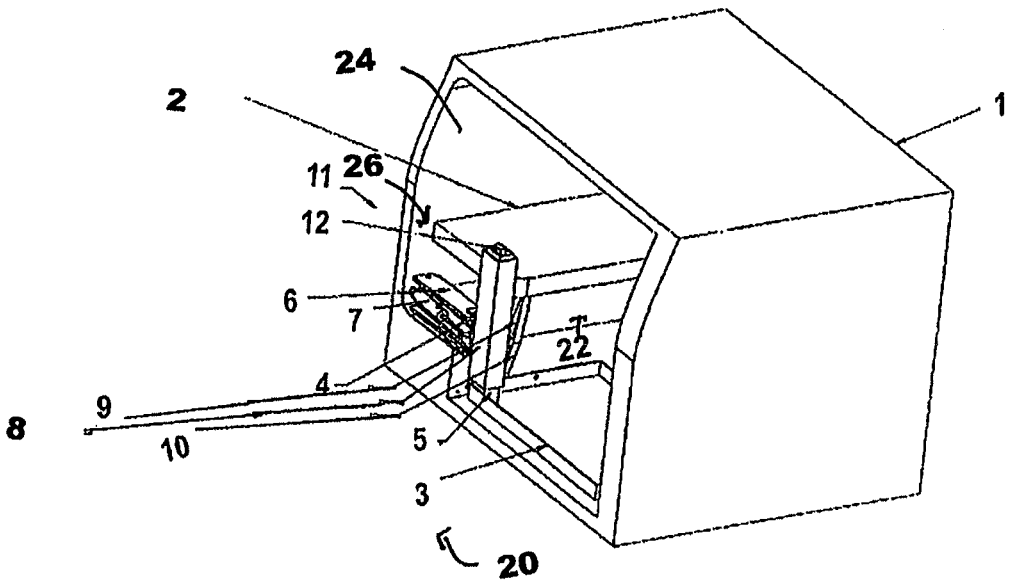
FIG. 2 is a perspective view of the example wheelchair lift shown in FIG. 1 with the lift tray in the retracted position.
Figure 3:
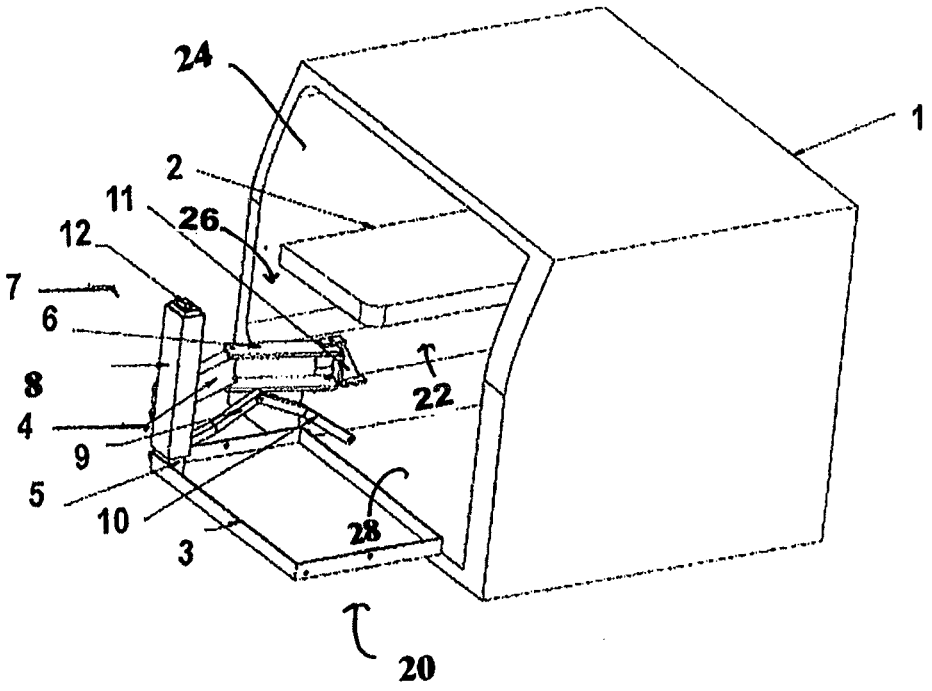
FIG. 3 is a perspective view of the example wheelchair lift shown in FIG. 1 with the lift tray in the partially extended position.

Referring to FIG. 2, this shows the wheelchair lift 20 in the retracted position. As shown, the articulated assembly 26 is positioned between the rear seat 3 and the door. FIG. 3 shows the wheelchair lift 20 in the horizontally outward position, approximately halfway through its articulation. FIG. 4 shows the wheelchair lift 26 in its fully extended position, with the inner vertical beam (5) fully extended to the ground. Although the articulated assembly 26 is shown to be adjacent the rear seat of the vehicle, it could be placed in other locations as well, including under the rear seat as well.

Referring to FIGS. 5 and 6, there is an embodiment with gull wing style doors that could be used in conjunction with the wheelchair lift assembly 20. As shown, the front and rear doors 30 are fused together and hinged in a typical gull wing manner, with the hinge located on the interior of the cab 1 with brackets securing door 30 and providing adjustments. As shown, a cylinder mounting post 12 is mounted to the top of the cab 1, near the door 30 opening. The door link 13 is attached to the cylinder mounting post 12 in a pivoting manner. A door cylinder 14 connects this link to the cab 1. The other end of the door link 13 could have a roller 15, or low friction slider that contacts the door in a manner that allows it to slide vertically on the door as it is opened and closed. At the end of the rollers (15) travel there is a pocket bracket 16, which will prevent the roller from separating significantly from the door. This allows the mechanism to create an inward force on the door in its closed position to help maintain a door seal. The typical operation of this unit would consist of opening the doors via the method mentioned above, or other various methods known to the art, then operating the horizontal cylinder to move the tray out from the cab, once it's clear of the cab floor, the vertical cylinder is operated to lower the tray to the ground. To return to the stowed position, this process is reversed. The actuation shown is done with hydraulic cylinders in the example shown, but could also be done with electrical actuators or pneumatic cylinders as well.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the disclosure.

What is claimed is:

1. A wheelchair lift for a vehicle having a cab with a rear seat, the wheelchair lift comprising:

a lift tray dimensioned to support a wheelchair;

a vertical lift assembly configured to raise and lower the lift tray;

an articulating assembly configured to move the lift tray and the vertical lift assembly transversely between an extended position in which the lift tray and the vertical lift assembly are outside the cab of the vehicle and a retracted position in which the lift tray and the vertical lift assembly are fully within the cab of the vehicle, wherein the articulating assembly includes a swivel beam pivotally mounted to the vertical wall of the vehicle cab, wherein the swivel beam is configured to pivot about a vertical axis, wherein the swivel beam is pivotally connected, either directly or indirectly, to the vertical lift assembly to pivot the vertical lift assembly between an extended position outside the cab of the vehicle and a retracted position fully within the cab of the vehicle, wherein the articulating assembly includes a swivel link pivotally connecting the swivel beam and the vertical lift assembly; and wherein the articulating assembly is mounted to a vertical wall of a vehicle cab between the rear seat and a vehicle door.

2. The wheelchair lift of claim 1, further comprising one or more guide linkages pivotally connecting the lift tray and the cab.

3. The wheelchair lift of claim 1, wherein the vertical lift assembly includes an inner vertical beam slidably engaged with an outer vertical beam.

4. The wheelchair lift of claim 3, wherein the inner vertical beam is attached to the lift tray.

5. The wheelchair lift of claim 4, further comprising a linear actuator configured to move the inner beam with respect to the outer beam.

6. The wheelchair lift of claim 1, wherein the articulating assembly is fully outside a space beneath the rear seat of the vehicle while moving between the extended and retracted positions.

7. A wheelchair lift for a vehicle having a cab with a rear seat, the wheelchair lift comprising:

a lift tray dimensioned to support a wheelchair;

a vertical lift assembly configured to raise and lower the lift tray;

an articulating assembly configured to pivot the lift tray and the vertical lift assembly transversely between an extended position in which the lift tray and the vertical lift assembly are outside the cab of the vehicle and a retracted position in which the lift tray and the vertical lift assembly are fully within the cab of the vehicle;

wherein the articulating assembly is mounted to a vertical wall of a vehicle cab between the rear seat and a vehicle door;

wherein the articulating assembly is fully outside a space beneath the rear seat of the vehicle while moving between the extended and retracted positions; and wherein the articulating assembly includes a swivel beam pivotally mounted to the vertical wall of the vehicle cab, wherein the swivel beam is pivotally connected, either directly or indirectly, to the vertical lift assembly.

8. The wheelchair lift of claim 7, further comprising one or more guide linkages pivotally connecting the lift tray and the cab.

9. The wheelchair lift of claim 7, wherein the vertical lift assembly includes an inner vertical beam slidably engaged with an outer vertical beam.

10. The wheelchair lift of claim 9, wherein the inner vertical beam is attached to the lift tray.

11. The wheelchair lift of claim 10, further comprising a linear actuator configured to move the inner beam with respect to the outer beam.

12. A vehicle comprising:

a vehicle cab with a rear seat, wherein the vehicle cab includes a vehicle door to provide access to the rear seat;

a wheelchair lift coupled with the vehicle cab, the wheelchair lift comprising:

a lift tray dimensioned to support a wheelchair;

a vertical lift assembly configured to raise and lower the lift tray;

an articulating assembly configured to pivot the lift tray and the vertical lift assembly transversely between an extended position in which the lift tray and the vertical lift assembly are outside the vehicle cab of the vehicle and a retracted position in which the lift tray and the vertical lift assembly are fully within the vehicle cab of the vehicle, wherein the articulating assembly is mounted to a vertical wall of the vehicle cab between the rear seat and the vehicle door, wherein the articulating assembly is fully outside a space beneath the rear seat of the vehicle while moving between the extended and retracted positions;

wherein the articulating assembly includes a swivel beam pivotally mounted to the vertical wall of the vehicle cab, wherein the swivel beam is pivotally connected, either directly or indirectly, to the vertical lift assembly; and wherein the articulating assembly includes a swivel link pivotally connecting the swivel beam and the vertical lift assembly.

13. The vehicle of claim 12, further comprising one or more guide linkages pivotally connecting the lift tray and the cab.

14. The vehicle of claim 12, wherein the vertical lift assembly includes an inner vertical beam slidably engaged with an outer vertical beam.

15. The vehicle of claim 14, wherein the inner vertical beam is attached to the lift tray.

16. The vehicle of claim 15, further comprising a linear actuator configured to move the inner beam with respect to the outer beam.

* * * * *